United States Patent [19]

Oberto

[11] Patent Number: 4,511,271

[45] Date of Patent: Apr. 16, 1985

[54] TYPING RIBBON CARTRIDGE WITH BLOCKING ELEMENT

[75] Inventor: Giacomo Oberto, Pavone, Italy

[73] Assignee: Olivetti Accessori, S.p.A., Ivrea, Italy

[21] Appl. No.: 501,819

[22] Filed: Jun. 7, 1983

[30] Foreign Application Priority Data

Jun. 7, 1982 [IT] Italy ..... 67728 A/82

[51] Int. Cl.[3] ..... B41J 35/28

[52] U.S. Cl. ..... 400/208; 400/234; 242/198

[58] Field of Search ..... 400/207, 208, 208.1, 400/674, 234; 242/197, 198, 199, 200

[56] References Cited

U.S. PATENT DOCUMENTS

| | | | |
|---|---|---|---|
| 3,074,545 | 1/1963 | Lasher | 400/208 |
| 4,010,839 | 3/1977 | Guerrini et al. | 400/227 X |
| 4,272,202 | 6/1981 | Schroeder et al. | 400/234 X |
| 4,401,394 | 8/1983 | Hume et al. | 400/208 |

*Primary Examiner*—Clifford D. Crowder
*Assistant Examiner*—Charles A. Pearson
*Attorney, Agent, or Firm*—Banner, Birch, McKie & Beckett

[57] ABSTRACT

A cartridge for a typing ribbon comprises a container having a bottom with a series of seat openings provided at positions confronting a supply reel and a cover having a series of ribs which project into the container at positions confronting the reel. A blocking element comprises a flat plate of limited thickness having a series of dished portions capable of being forcibly fitted into the corresponding seat openings of the bottom to lift the supply reel and urge the upper edge of the ribbon against the ribs which prevents the turns from unwinding during storage and transportation of the cartridge. Channels co-operate with fixing elements on the machine and an opening 31 provides access for a sensing element. The blocking element comprises a first limb portion capable of covering the channel and the opening and a second limb portion capable of covering the channel in such a way as to prevent the cartridge from being mounted on the machine when the blocking element is mounted on the cartridge.

7 Claims, 5 Drawing Figures

TYPING RIBBON CARTRIDGE WITH BLOCKING ELEMENT

BACKGROUND OF THE INVENTION

The present invention relates to a cartridge for a typing ribbon with a blocking element, comprising a container in which a ribbon supply reel is rotatable and a blocking element acting between the reel and the container to prevent the reel from winding when the cartridge is not mounted on a typewriter or other typing machine.

A cartridge is known, in which a blocking element is inserted in a groove or channel disposed in the container in the region of the supply reel, so as to act between the lower part of the cover and the upper edge of the ribbon, thus compressing the supply reel against the bottom of the container. The blocking element thus prevents the typing ribbon from unwinding when that is not wanted. If however the user operates the manual forward feed disc, rotating it can cause the ribbon to feed forward, with a certain amount of difficulty. The known cartridge, with the specific blocking element, suffers from the disadvantage that, if the user is not paying attention, he can fit the cartridge to a machine with the blocking element still in position. The ribbon feed devices of the machine thus cause rotary movement and forward feed of the ribbon. However, since the supply reel is subjected to friction and restrained or checked, in the long run problems occur such as excessive wear of the ribbon feed device, as well as the possibility of breakage of the ribbon and the device itself.

SUMMARY OF THE INVENTION

The object of the present invention is therefore to provide a cartridge with a blocking element, which is simple, reliable, and inexpensive and which prevents the cartridge from being fitted with the blocking element still in position.

The cartridge according to the present invention comprises a blocking element having at least one portion capable of preventing the cartridge from being fitted to the machine.

BRIEF DESCRIPTION OF THE DRAWING

The invention will now be described in more detail, by way of example, with reference to the accompanying drawing, in which.

DESCRIPTION OF THE PREFERRED EMBODIMENT

Figure 1:
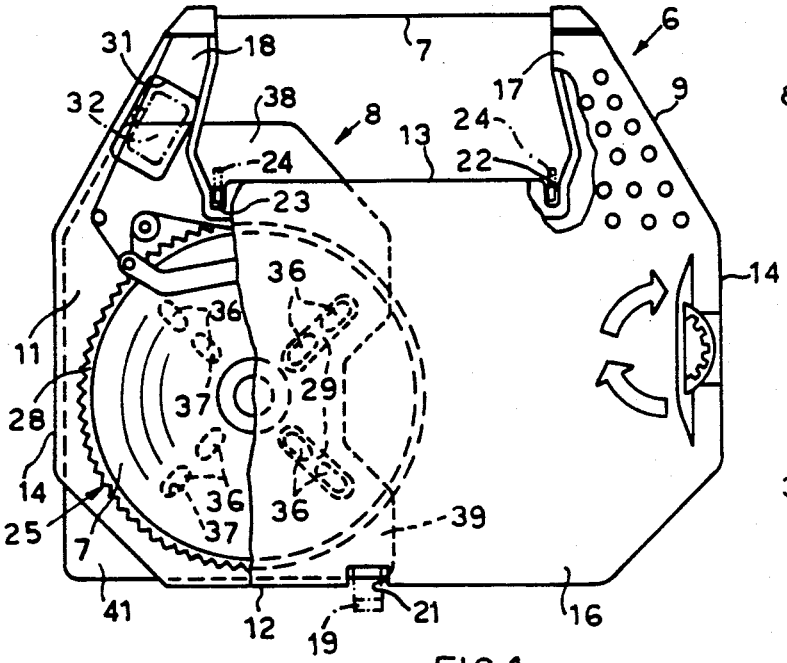
FIG. 1 is a plan view of part of a cartridge with a blocking element mounted on the cartridge.

Referring to FIG. 1, a removable cartridge 6 holds a typing ribbon 7 and a blocking element 8 is mounted on the cartridge. The cartridge 6 comprises a container 9 having a bottom 11, a front wall portion 12, a rear wall portion 13, two side wall portions 14 and a cover 16 which closes the container at the top thereof. The cartridge 6 has two arms 17 and 18 which project from the rear wall portion 13, and it is normally removably fixed on a typewriter by means of a leaf spring 19 which is engaged in a groove or channel 21 in the front wall portion 12 and holds two grooves or channels 22 and 23 adjacent to the arms 17 and 18, respectively engaged against corresponding fixed abutments 24 on the machine.

Figure 2:
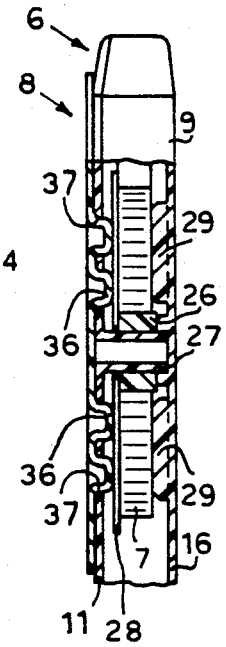
FIG. 2 shows a side view in cross-section of part of the cartridge shown in FIG. 1.

Housed in the container 9 is a supply reel 25, on which the typing ribbon 7 is wound. The supply reel 25 comprises a hub 26 (FIG. 2) which is rotatable about a sleeve 27 which projects from the bottom 11, and a flange 28 which is fixed to the lower end of the hub 26.

The cover 16 comprises four ribs 29 which project inwardly of the cartridge 6 and which are disposed at 90° relative to each other and which are capable of co-operating with the upper edge of the ribbon 7 when the blocking element 8 is mounted on the cartridge 6. Only two such ribs 29 can be seen in the drawing.

Figure 4:
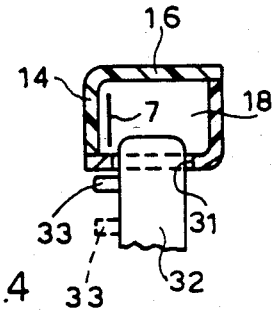
FIG. 4 shows a partly sectional view of some details of FIG. 1.
Figure 5:
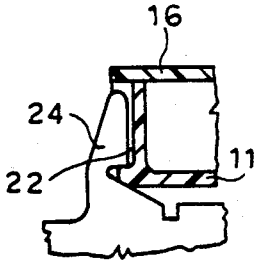
FIG. 5 shows a partly sectional view of further details from FIG. 1.

The arm 18 (see FIG. 1) comprises a seat opening 31 for housing a sensing element 32 having a lever 33 (FIG. 4), which is movable from a first position shown in solid lines in FIG. 4, which indicates that the cartridge 6 is not present, to a second position as shown in broken lines, which indicates that the cartridge 6 is fitted on the machine. The cartridge 6 is substantially similar to that described in the U.S. Pat. No. 4,010,839 and will therefore not be described in greater detail herein.

Figure 3:
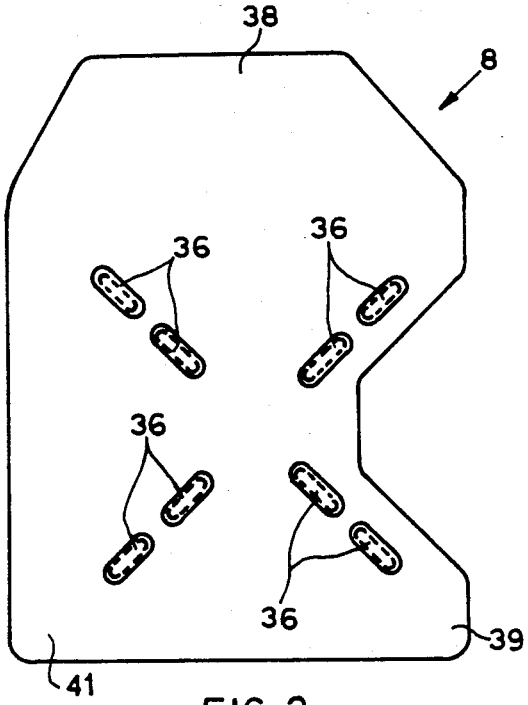
FIG. 3 shows a plan view on an enlarged scale of the blocking element shown in FIG. 1.

The blocking element 8 (see FIG. 3) comprises a plate of limited thickness, being substantially flat and comprising plastics material and having a series of eight dished or drawn portions 36 which project from the plane of the plate and which are aligned in two mutually perpendicular lines. The eight dished portions 36 are grouped in four pairs each disposed on one of the four halves of the two lines. The eight dished portions 36 are capable of being snapped into eight corresponding openings or slots 37 (see FIG. 2) which are provided in the bottom 11 of the container 9, when the blocking element 8 is mounted on the cartridge 6. The blocking element 8 comprises a first limb portion 38 (see FIG. 1) which is capable of covering the groove or channel 23 and in part the seat opening 31, in such a manner as to prevent the abutment 24 engaging with the channel 23 and engagement of the sensing element 32 in the opening 31. In addition, the blocking element 8 comprises a second limb portion 39 which is opposite to the first limb portion 38 and which is arranged to cover the channel or groove 21 in which the spring 19 is received.

In order to fit the blocking element 8, it is placed against the bottom 11 of the container 9 with the dished portions 36 in register with the openings 37. A moderate pressure is now applied to force the portions 36 to engage into the openings 37. As the portions 36 engage the corresponding openings 37, the portions 36 press against the bottom of the flange 28, which is raised with the ribbon 7 until the upper edge of the ribbon 7 bears against the ribs 29. The element 8 is in contact with the bottom 11 and the supply reel 25 is held with the ribbon 7 against the ribs 29. At the same time, the first and second limb portions 38 totally cover the grooves or channels 21 and 23 and partially cover the opening 31, thereby preventing the spring 19, the fixed abutment 24 and the sensing element 32 from engaging into the respective grooves or openings, as shown in FIG. 1.

To remove the blocking element 8 from the cartridge 6, a free corner 41 of the element 8 is gripped with one hand and, by pulling it strongly away from the bottom 11, the portions 36 come out of the respective openings 37, whereby the flange 38 moves downwardly until it touches the bottom 11 and the upper edge of the ribbon 7 is disengaged from the ribs 29 and the cartridge 6 is ready to be fitted to the machine.

The blocking element 8 is sufficiently thin to allow the cartridges 6 to be stacked when their elements 8 are fitted more or less exactly as they stack without their blocking elements.

What I claim is:

1. A removable cartridge for a typing ribbon with a blocking element comprising a container having a bottom and a cover, wherein the bottom comprises a sleeve and a series of slots and the cover comprises four ribs which project inwardly of the container and are disposed at 90° relative to each other; and a ribbon supply reel, on which the typing ribbon is wound, comprising a hub which is rotatable about the sleeve and a flange which is fixed to the lower end of the hub; and wherein the blocking element comprises a substantially flat plate of limited thickness having a series of dished portions which project from the plane of the plate and which are snapped into the series of slots for engaging the lower surface of the flange and raising the ribbon supply reel until the upper edge of the typing ribbon is arrested against the four ribs, when the blocking element is mounted on the cartridge, so as to prevent the ribbon supply reel from unwinding when the cartridge is not mounted on a typing machine.

2. A cartridge according to claim 1, wherein the typing machine comprises a sensing element for signaling the presence of the cartridge and the container comprises a seat opening, and the blocking element comprises a second portion which blocks off said seat opening which is capable of receiving the sensing element.

3. A cartridge according to claim 1, wherein the dished portions are forced into the slots in the bottom of the container during the mounting of the blocking element on the cartridge.

4. A cartridge according to claim 1, wherein the plate is of such small thickness as to permit correct stacking of the cartridges with their blocking elements fitted.

5. A removable cartridge according to claim 1, wherein the container includes at least two grooves and the typing machine comprises two abutments for engaging said two grooves and removably fixing the cartridge on the typing machine, wherein the blocking element comprises at least one portion for filling at least one groove of said two grooves and preventing the cartridge from being mounted on the typing maching when the blocking element is mounted on the cartridge.

6. A cartridge for a typing ribbon with a blocking element comprising a container having a bottom and a cover, wherein the bottom comprises a series of slots and the cover comprises a series of ribs which project inwardly of the container; and a ribbon supply reel on which the typing ribbon is wound comprising a flange and being rotatable in the container; wherein the blocking element comprises a substantially flat plate having a series of dished portions which project from the plane of the plate and which is snapped into the series of slots for engaging the lower surface of the flange and raising the ribbon supply reel until the upper edge of the typing ribbon is arrested against the series of ribs, when the blocking element is mounted on the cartridge, so as to prevent the ribbon supply reel from unwinding when the cartridge is not mounted on a typing machine; wherein the container includes at least one groove and the typing machine comprises an abutment for cooperating and engaging said groove for fixing the cartridge on the typing machine; and wherein the blocking element comprises at least one portion for filling said groove and preventing the cartridge from being mounted on the typing machine.

7. A cartridge according to claim 6, wherein the series of dished portions is aligned in two mutually perpendicular lines and comprises eight dished portions which are grouped in four pairs each disposed on one of the four halves of the two lines, wherein the series of slots of the bottom comprises eight slots and wherein said eight dished portions are snapped into said corresponding eight slots.

* * * * *